US007419332B1

(12) United States Patent
Brochu et al.

(10) Patent No.: US 7,419,332 B1
(45) Date of Patent: Sep. 2, 2008

(54) LEACHING CHAMBER WITH STRENGTHENED DOME END

(76) Inventors: Ronald P. Brochu, 4 Brittany La., Westbrook, CT (US) 06498; James J Burnes, 10 Tower Hill Rd., Deep River, CT (US) 06417

( * ) Notice: Subject to any disclaimer, the term of this patent is extended or adjusted under 35 U.S.C. 154(b) by 0 days.

(21) Appl. No.: 11/018,148

(22) Filed: Dec. 20, 2004

Related U.S. Application Data

(63) Continuation-in-part of application No. 10/442,810, filed on May 20, 2003, now Pat. No. 7,351,006.

(51) Int. Cl.
*E02B 11/00* (2006.01)

(52) U.S. Cl. ..... 405/46; 405/49

(58) Field of Classification Search ..... 405/43, 405/44, 45, 46, 47, 48, 49; 210/170; D23/207
See application file for complete search history.

(56) References Cited

U.S. PATENT DOCUMENTS

| | | | | | |
|---|---|---|---|---|---|
| 5,087,151 | A * | 2/1992 | DiTullio | ..... | 405/43 |
| D329,684 | S * | 9/1992 | Gray | ..... | D23/207 |
| 5,511,903 | A * | 4/1996 | Nichols et al. | ..... | 405/43 |
| 5,588,778 | A * | 12/1996 | Nichols et al. | ..... | 405/48 |
| 6,076,993 | A * | 6/2000 | Gray | ..... | 405/43 |
| D477,381 | S * | 7/2003 | Benecke | ..... | D23/207 |
| 6,679,653 | B1 * | 1/2004 | DiTullio | ..... | 405/49 |
| 6,698,975 | B1 * | 3/2004 | Benecke | ..... | 405/43 |

* cited by examiner

*Primary Examiner*—M. Safavi
(74) *Attorney, Agent, or Firm*—C G Nessler; S McHugh

(57) ABSTRACT

A molded plastic corrugated arch shape cross section leaching chamber has a dome end for forming a pivotable joint with a like chamber. The dome of the dome end has one or more preferably trapezoid shape shallow surface depressions, for strength. The depressions are specially placed so that soil cannot enter the interior of the chambers, regardless of the angle between the chambers.

7 Claims, 2 Drawing Sheets

LEACHING CHAMBER WITH STRENGTHENED DOME END

This application is a continuation in part of patent application Ser. No. 10/442,810 of Burnes et al. "Leaching Chambers Joined Together With Swivel Connections," filed May 20, 2003.

TECHNICAL FIELD

The present invention relates to leaching chambers and equivalent devices for receiving or dispersing liquids in soil, and which can be joined to each other at a selected angle, when being installed.

BACKGROUND

Molded plastic leaching chambers are widely used for dispersing wastewater into soil and other media. Typically, a trench is cut in soil, and a string of interconnected chambers is buried in the soil. Whenever possible, chamber strings run level along a more or less straight line. However, there are other instances where strings of chambers must follow a not straight path, for instance, to run level along the side contour of a hillside, or to run around an obstruction such as a boulder or ledge.

Thus, there has been a continuing need for connecting together chambers so that a chamber string approximates a curve in various degrees. While come prior art chambers provide a little flexibility in such respect, for instance plus or minus 3 degrees of angling, but that has not been sufficient. Chambers or adapters having an angled end, such as described in U.S. Pat. No. 5,588,788 to Nichols and U.S. Pat. No. 5,669,733 to Daly et al. have found limited favor, since they do not provide fine adjustment, and it becomes necessary to have additional inventory of chambers. There is a use for angling chambers which are used in other applications, such as those for handling storm waters. The means provided must be strong, durable, and effective at prohibiting migration of surrounding soil into the chamber interior in vicinity of the joint.

The means must be economical to fabricate and easy to use. And, since nesting height is important, the means should not increase such, as would be the case for commonly used ribbing.

SUMMARY

An object of the invention is to provide a molded plastic chamber, used for leaching or other water dispersing purpose, with a pivotable end, particularly an end comprising a dome, with strength, while preventing intrusion of soil at the joint and without increasing nest height.

In accord with the invention, a molded plastic corrugated arch shape cross section leaching chamber has a first dome end, an opposing second chamber end, shaped to overlap the dome to enable a pivotable joint between mated chambers and the dome has at least one depression. Preferably, the dome is a portion of a surface of revolution which is congruent with the curve of the arch cross section, which is preferably a nominal semi-ellipse.

In further accord with the invention, the depression is trapezoidal shaped; and the larger trapezoid base end is at a higher elevation than the opposing trapezoid end. Preferably, the chamber dome comprises a second trapezoidal shape depression having a smaller shape than the first trapezoidal depression, and the second depression located further from the edge of the end of the chamber than the first depression.

The foregoing and other objects, features and advantages of the present invention will become more apparent from the following description of preferred embodiments and accompanying drawings.

DESCRIPTION

Figure 1:
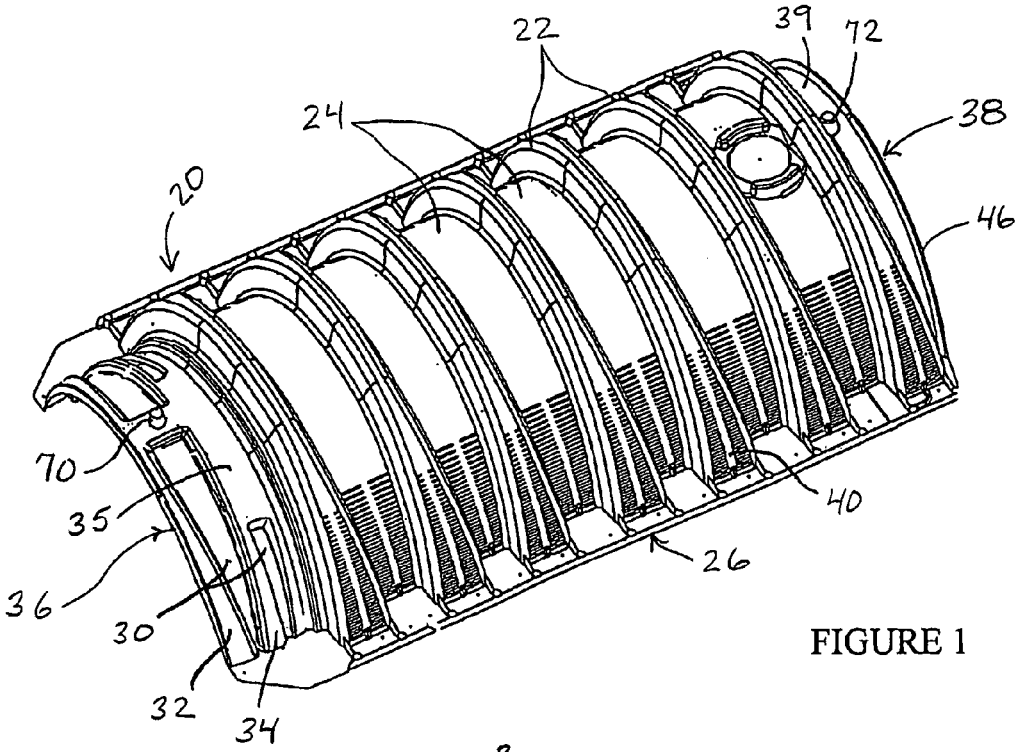
FIG. 1 is an isometric view of a leaching chamber having a dome end.

FIG. 1 shows a chamber 20, like that described in commonly assigned co-pending U.S. patent application Ser. No. 10/677,938 "Corrugated Leaching Chamber" of Brochu et al. and Ser. No. 10/677,772 "Leaching Chamber with Inward Flaring Sidewall Perforations" of Swistak et al., the disclosures of which are hereby incorporated by reference. Chambers embodying features shown in the patents are now sold commercially as Infiltrator® Quick4™ chambers.

Preferably, chamber 20 is made of injection molded commercial polypropylene, alternately high density polyethylene. Use may be made of gas-assisted injection molding methodology described in U.S. Pat. No. 5,401,459, and in the references cited therein. For clarity of illustration, small ribs, injection molding sprues, runners, knock out pin features, etc., have been omitted. A typical chamber is 34 in. wide at the base, about 15 in. maximum height, and about 52 in. long. When many like chambers are joined together, each chamber adds about 48 in. in length to a string of chambers. The height H of the top of the dome end is, for example, about 10.5 in. to 13 in. An exemplary peak height is about 12 to 16 in. The chamber has a basic wall thickness, away from perforated regions, of about 0.09 in.

Chamber 20 has corrugations which comprise peaks 22 and valleys 24 running along the continuous curve, preferably a truncated-elliptical curve, of the arch shape cross section to connect opposing side feet 26, which comprise the base of the chamber and transfer vertical loads to the soil. The chamber first end 36 comprises a surface-of-revolution dome 35, which enables horizontal plane chamber-pivoting, as described herein. The opposing second end 38 of an identical chamber can be overlaid on the first end, so male molded pin 70 is enveloped by female molded pin 72. That forms a joint between the chambers which provides for pivoting about the pins, and thus, angling of the chambers in the horizontal plane. In the generality of the present invention, the pin or pivot interconnection at the top of the dome end might be omitted; and, use may be made of alternative means for keeping the chambers longitudinally engaged, such as field installed screws, adhesives, etc.

Each opposing-side foot 26 is comprised of a horizontal flange having a fin running lengthwise along the outer edge thereof, to provide lengthwise rigidity to the foot Vertical ribs run transversely and horizontally along the flange, to connect the opposing side edges of the bases of the peak corrugations to the fin.

The end 36 is called here the dome end; the opposing end 38 is called the ordinary end. The ordinary end has a curved cross section, and comprises a portion, often referred to as an end flange in the prior art, which is suitable for overlapping another chamber. In chamber 20, the ordinary end 38 is shaped to overlap and mate in swivel fashion with the dome end. The end 38 has an interior curve geometry which is nominally congruent with the curve of the inside edge of the peaks (i.e., the curve of the valleys) of the main body of the corrugated chamber. The actual dome portion 35 is preferably a surface of revolution, running through an arc of about 20 degrees (i.e., plus or minus 10 degrees from parallelism) in the preferred chamber. Greater or lesser angle may be used. Interference of the edge or end 38 with the peak nearest end 36 will tend to limit maximum angle. Alternative means may be put on the chamber end, in particular on the flange at the base of the dome, which is also called the slide, for of limiting rotation.

Figure 3:
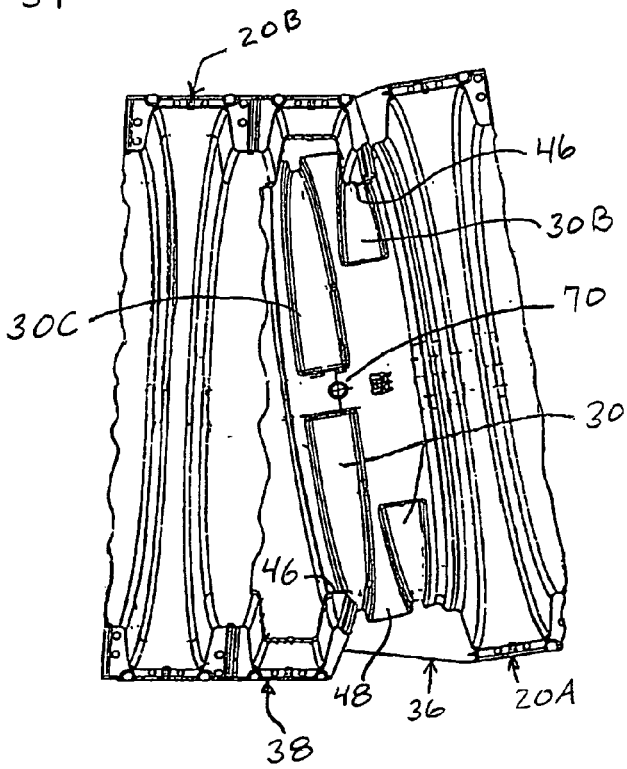
FIG. 3 is a partial cutaway view of the joint formed between two chambers of FIG. 1.

The curving of dome 35 in the horizontal plane is seen in FIG. 3 which shows a joint between two like chambers. The dome portion 35 runs continuously from one base flange to the other. In the generality of the invention, the top of the dome may be truncated.

The contour of dome 35 in the vertical cross section plane is shaped to match the path which is followed by the inner parts of end 38, when the end of a like chamber is mounted on and rotated about pin 70 at dome end 36. In context, that there is ordinary provision for clearance and variation, there is line contact, or near-line contact, between the dome surface and the interior of end 38. Thus, entry of soil into the interconnected chambers will be inhibited, and load may be transferred from end 38 of a second chamber to end 36 of a first chamber.

In chamber 20, the curving sidewall of the dome is generally congruent with, and more preferably matches, the curve of the cross section geometry of the main part of the chamber body. In other embodiments, the vertical plane curve of end 38 and thus the contour dome 35 may be different from the contour of the central part of the chamber.

The dome portion of end 36 has one or more molded in depressions 30. Preferably there is a large depression 30C near the outer edge of the end, and a smaller depression 30B, inboard of the larger one. The molded in depressions 30 provide rigidity to the dome and entirety of the end, and the pair of joined-together chambers. The depressions are specially shaped as trapezoids, so that significant ingress of soil at the joint will not occur even though it might appear the depressions would allow soil to move under the end 38 of a mated chamber and through the depression area.

Figure 4:
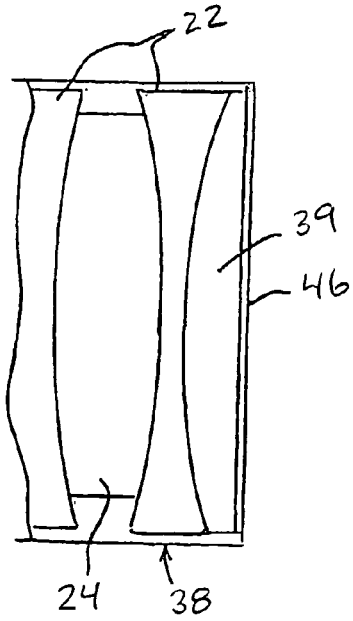
FIG. 4 is a simplified top view of the ordinary end 38 of a chamber.

The reason this is not so can be understood from FIGS. 3 and 4. The end 38 has a plain curved portion, called end flange 39, abutting the outer edge 46 of the end, which is wider (measured along the length of the chamber) at the top than the base. Thus depressions 30 are preferably have a shape which is trapezoidal, when the boundaries of the depressions are projected into the vertical longitudinal center plane of the chamber. (Of course, the depression can also be viewed as a curved or contour surface trapezoid.) The larger end of the depression trapezoid, often called the base of the trapezoid, is at a higher elevation than the lower end. Where the depressions are wider, the flange 39 is wider, and at any angle of rotation at least one edge of the depression with be overlaid by part of flange 39. So, while at some rotational positions soil will obvious fill a depression, it cannot pass further toward the interior of the chamber. Of course, the soil does not surround the chamber during installation, and once buried, there is no further horizontal plane movement at the joint.

In the exemplary chamber, the larger depression is about 1 inch deep at the top, tapering down to about 0.5 inch deep near the base. Since the depression is shallow it does not interfere with the low nest height feature of the chamber, as might ribbing.

Figure 2:
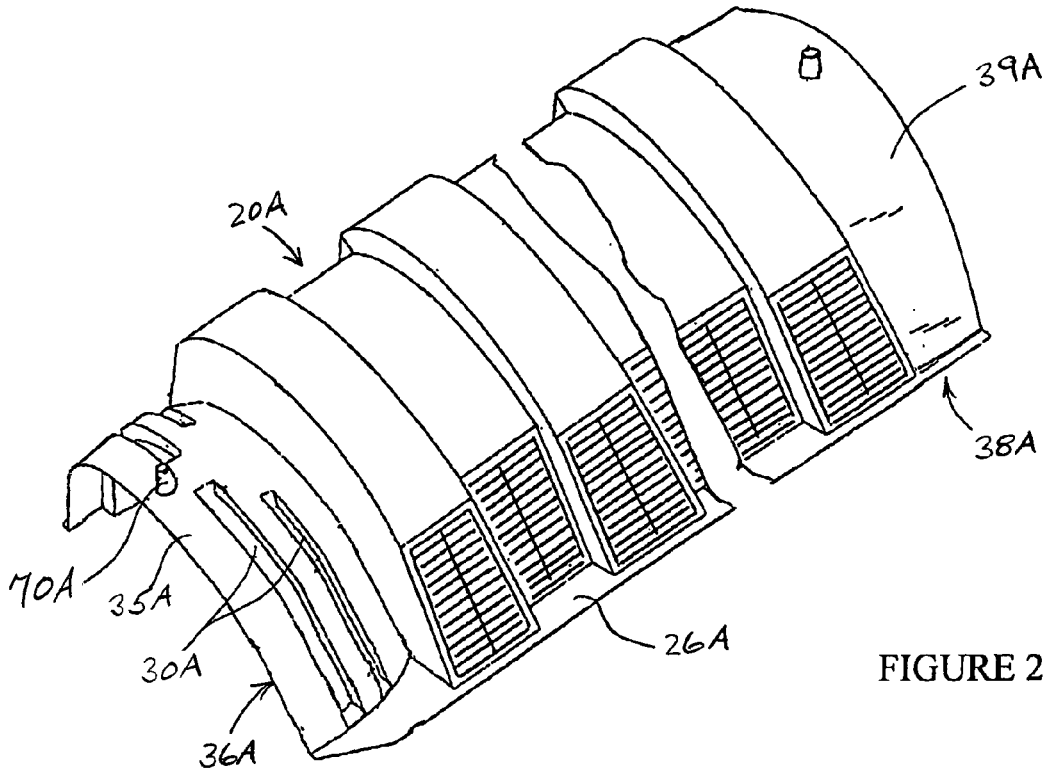
FIG. 2 is an isometric view of the end of another embodiment leaching chamber.

FIG. 2 shows an alternate embodiment chamber 20A having features corresponding to chamber 20, designated by number suffixes. Since the end flange 39A is substantially bigger, the dome 35A may have depressions which are not trapezoidally shaped, for example, they are rectangles. However, the ends will have greater length compared to ends which have "upside down" trapezoid shape depressions.

An important feature of the depressions, compared to ribs is that the depressions will nest within one another when chambers are stacked or nested, and thus they will not have an adverse effect on nesting height of the chambers, which is especially good because of the features described in related applications, including the application of Brochu et al. Atty. No. 2446 Low Nest-Height Thermoplastic Leaching Chamber, filed on even date herewith.

Although this invention has been shown and described with respect to a preferred embodiment, it will be understood by those skilled in this art that various changes in form and detail thereof may be made without departing from the spirit and scope of the claimed invention.

We claim:

1. A molded plastic corrugated arch shape cross section leaching chamber, comprising:

a first chamber end having a dome and an outer edge;

an opposing second chamber end, shaped to overlap the dome of a like chamber and to thereby form a pivotable joint between the chambers, wherein the second end overlies the dome when chambers are joined together, the second end having a flange, the interior concavity of which fits the exterior surface of the dome, wherein the exterior surface of the dome has at least one upwardly running elongated depression, wherein a projection of the at least one upwardly running elongated depression into the vertical plane has the shape of a trapezoid, wherein the larger trapezoid base end is at a higher elevation than the opposing smaller trapezoid end and wherein the at least one upwardly running elongated depression includes a first trapezoidal depression and a second trapezoidal depression, the second trapezoidal depression having smaller dimensions than the first trapezoidal depression and being located further from the outer edge of the end of the chamber than the first trapezoidal depression.

2. The chamber of claim 1, wherein each depressions is at least about 0.5 inch deep.

3. A molded plastic corrugated arch shape cross section leaching chamber which comprises:

a first chamber end having a dome formed by a portion of a surface of revolution, wherein the dome includes an inner edge and an outer edge;

an opposing second chamber end shaped to overlap the dome of the first chamber end of a like chamber and to thereby form a pivotable joint between the chambers, wherein the second end overlies the dome of the first chamber end of a like chamber when chambers are joined together, the second end having a flange, the interior concavity of which fits the exterior surface of the dome of the first chamber end of a like chamber;

wherein the dome exterior surface has at least one upwardly running elongated depression spaced apart from both the inner edge and the outer edge of the dome.

4. The chamber of claim 3, wherein a projection of the at least one depression into a vertical plane has the shape of a trapezoid, wherein the larger trapezoid base end is at a higher elevation than the opposing smaller trapezoid end.

5. The chamber of claim 3, wherein the flange width increases with elevation.

6. The chamber of claim 3, further comprising: means for pin connection near the top of the chamber, proximate the chamber first end, to engage the overlapping second end of a like chamber.

7. The chamber of claim 3, wherein a projection of the at least one depression into a vertical plane is substantially rectangular in shape.

* * * * *